US007228694B2

(12) United States Patent
Schwarz et al.

(10) Patent No.: US 7,228,694 B2
(45) Date of Patent: Jun. 12, 2007

(54) COOLING CONTROL SYSTEM FOR AN AMBIENT TO BE COOLED, A METHOD OF CONTROLLING A COOLING SYSTEM, AND A COOLER

(75) Inventors: Marcos Guilherme Schwarz, Joinville (BR); Marcio Roberto Thiessen, Joinville (BR)

(73) Assignee: Empresa Brasileira de Compressores S.A. - Embraco, Joinville - SC (BR)

( * ) Notice: Subject to any disclaimer, the term of this patent is extended or adjusted under 35 U.S.C. 154(b) by 0 days.

(21) Appl. No.: 10/487,287

(22) PCT Filed: Jun. 21, 2002

(86) PCT No.: PCT/BR02/00088

§ 371 (c)(1),
(2), (4) Date: Jul. 13, 2004

(87) PCT Pub. No.: WO03/019090

PCT Pub. Date: Mar. 6, 2003

(65) Prior Publication Data

US 2004/0237551 A1 Dec. 2, 2004

(30) Foreign Application Priority Data

Aug. 29, 2001 (BR) ..... 0103786

(51) Int. Cl.
*G05D 23/32* (2006.01)
*F25B 49/00* (2006.01)
*F25B 19/00* (2006.01)

(52) U.S. Cl. ..... 62/228.4; 62/157; 62/229; 62/230; 62/231

(58) Field of Classification Search ..... 62/157, 62/229, 230, 231, 228.4, 228.5
See application file for complete search history.

(56) References Cited

U.S. PATENT DOCUMENTS 3,355,906 A 12/1967 Newton
4,495,778 A 1/1985 Shaw (Continued)

FOREIGN PATENT DOCUMENTS

EP 0 278 630 8/1988

(Continued)

OTHER PUBLICATIONS

International Search Report for PCT/BR02/00088 completed Aug. 22, 2002.

*Primary Examiner*—Cheryl Tyler
*Assistant Examiner*—B. Clayton McCraw
(74) *Attorney, Agent, or Firm*—Alston & Bird LLP

(57) ABSTRACT

A cooling system for cooling an ambient to be cooled, a cooler and a method of controlling a cooling control system are described. The cooling control system comprises a variable capacity compressor and a controller, the controller measuring the load of the compressor by means of the measurement of the electric current and verifying the temperature condition in the cooler ambient and actuating on the cooling capacity of the compressor, the compressor being controlled to actuate in cycles, the cooling capacity being altered in function of an evolution of the load of the compressor along the cooling cycles in combination with an evolution of the temperature condition in the cooled ambient.

31 Claims, 7 Drawing Sheets

U.S. PATENT DOCUMENTS 4,653,285 A * 3/1987 Pohl ..... 62/126
4,850,198 A 7/1989 Helt et al.
5,410,230 A 4/1995 Bessler et al.
5,493,868 A * 2/1996 Kikuiri et al. ..... 62/129
5,592,059 A 1/1997 Archer
5,669,225 A 9/1997 Beaverson et al.
6,076,367 A * 6/2000 Sandofsky et al. ..... 62/209
6,134,901 A * 10/2000 Harvest et al. ..... 62/228.4
6,318,966 B1 * 11/2001 Madara et al. ..... 417/12
6,593,717 B2 * 7/2003 Yoshimura ..... 318/471
2001/0013225 A1 * 8/2001 Ota et al. ..... 62/228.5

FOREIGN PATENT DOCUMENTS

EP 278630 A2 * 8/1988
EP 0 501 432 9/1992

* cited by examiner

COOLING CONTROL SYSTEM FOR AN AMBIENT TO BE COOLED, A METHOD OF CONTROLLING A COOLING SYSTEM, AND A COOLER

BACKGROUND OF THE INVENTION

1. Field of the Invention

The present invention relates to a cooling-control system for an ambient to be cooled, a method of controlling a cooling system, as well as a cooler, particularly making use or a compressor with variable capacity applied to cooling systems in general, this system and method enabling one to use conventional thermostats of the type that alter the conduction condition of a contact depending upon the minimum and maximum limits of temperature of the compartment or ambient to be cooled, permitting adjustment of the rotation or characteristics of the compressor, so as to maximize the performance of the cooling system.

The basic objective of a cooling system is to maintain a low temperature inside one (or more) compartment(s) or ambient(s) to be cooled, making use of devices that convey heat out of the latter to the external ambient, by resorting to measurements of temperature inside said compartment(s) or ambient(s) to control the devices responsible for conveying heat, trying to maintain the temperature within pre-established limits for the type of cooling system in question.

Depending upon the complexity of the cooling system and of the type of application, the temperature limits to be maintained are more restrict or not.

A usual way of conveying heat out of a cooling system to the external ambient is to use a hermitic compressor connected to a cooling closed circuit (or cooling circuit), through which a cooling fluid or gas circulates, this compressor having the function of causing the cooling gas to flow inside the cooling closed circuit, and is capable of imposing a determined difference in pressure between the points where evaporation and condensation of the cooling gas occurs, enabling the processes of conveying heat and creating a low temperature to take place.

Compressors are dimensioned to supply a cooling capacity higher than that required in a situation of normal operation, and critical situations are foreseen. Then some kind of modulation of the cooling capacity of this compressor is necessary to maintain the temperature inside the cabinet within acceptable limits.

2. Description of Related Art

The most common way of modulating the cooling capacity of a compressor is to turn it on and off, according to the evolution of the temperature inside the ambient to be cooled. In this case, one resorts to a thermostat that turns the compressor on when the temperature in the ambient to be cooled exceeds the pre-established limit, and turns it off when the temperature inside this ambient has reached a lower limit, also pre-established.

A known solution for this control device for controlling the cooling system is the combination of a bulb containing a fluid that expands with the temperature, installed so as to be exposed to the temperature inside the ambient to be cooled and mechanically connected to an electromechanical switch that is sensitive to that expansion and contraction of the fluid existing inside the bulb. It is capable of turning on and off the switch at predefined temperatures, according to its application. This switch interrupts the current supplied to the compressor, controlling its operation, maintaining the internal ambient of the cooling system within pre-established temperature limits.

This is further the most widely used type of thermostat, since it is simple, but it has the limitation of not permitting adjustment of the speed of a compressor of variable capacity, because it generates the command of opening and closing a contact responsible for interrupting the power fed to the compressor.

Another solution for controlling the cooling system is to use an electronic circuit capable of reading the temperature value inside the cooled ambient by means of a PTC-TYPE (Positive Temperature Coefficient) electronic temperature sensor, for example; or another one, comparing this temperature value read with predetermined references, generating a command signal to the circuit that manages the energy fed to the compressor, providing the correct modulation of the cooling capacity, so as to maintain the desired temperature inside the cooled ambient, be it by turning the compressor on or off, or by varying the supplied cooling capacity, in the case in which the compressor if of the variable capacity type. A limitation of this type of thermostat is the fact that it incorporates an additional cost for promoting the adjustment of speed of the compressor, requiring its correct adaptation for this function, by means of some capacity of logic processing and control algorithms that define the correct operation speed of the compressor, implemented in the thermostat circuit, separately from the control over the compressor.

Another solution for controlling the temperature in a cooled ambient is described in U.S. Pat. No. 4,850,198, which discloses a cooling system comprising compressor, condenser, expansion valve and evaporators, in addition to a control over the energization of the compressor. This control is effected by means of a microprocessor according to a readout of temperature from a thermostat determining energization or no energization of the compressor on the basis of predetermined maximum and minimum temperature limits. According to this system, control over the operation time of the compressor depending upon the temperature measured in the cooled ambient is foreseen.

One also knows from the prior art the solution presented in document WO 98/15790, in which the speed of the axle and, consequently, the cooling capacity of the compressor is adjusted by the controller, resorting to the information on opening and closing the contacts of a simple thermostat, of the type that promotes the opening and closing of the thermostats of a switch depending upon two temperature limits. This technique adjusts the compressor speed to each operation cycle, reducing the compressor speed ii each cycle, in predefined steps.

The limitation of this solution is that the most adequate operation condition for the compressor is sought step by step in each cycle, which makes the system slower and limits its benefits. It also has a limitation in the reaction time, when a substantial increment in cooling capacity is required along a cooling cycle, limiting the capacity of stabilizing the temperatures and limiting the response to the addition of thermal loads to the cooler.

Another solution known from the prior art is described in document U.S. Pat. No. 5,410,230, in which one proposes a control, by which the operation speed of the compressor is adjusted in response to the temperature and a determined point of the cooling system, requiring a temperature measurement circuit, with the consequent cost disadvantages.

BRIEF SUMMARY OF THE INVENTION

The objectives of the present invention are to provide means for controlling the temperature inside a cooling system and to determine the operation speed of the variable capacity compressor, by making use of a conventional thermostat of the type that opens and closes a contact in response to a maximum and a minimum limit of temperature inside the cooled compartment.

A further objective of the present invention is to provide a control for a cooling system, capable of determining the operation speed of a variable capacity compressor, dispensing with the need for electronic thermostats with logic processing capacity and, therefore, a more economical system.

A further objective of the present invention is to provide a control for a cooling system, capable of determining the operation speed of a variable capacity compressor, determining the most adequate speed for operation of the compressor, thus minimizing the consumption of energy.

A further objective of the present invention is to provide a control for a cooling system, capable of determining the operation speed of a variable capacity compressor, minimizing the time of response to the variations of thermal loads imposed on this cooling system.

A further objective of the present invention is to provide a control for a cooling system, capable of determining the operation speed of a variable capacity compressor, correcting the operation capacity of the compressor along the operation cycle under way.

The objectives of the present invention are achieved by means of a control system for controlling an ambient to be cooled, in which a thermostat actuating in response to two maximum and minimum limits of temperature is capable of indicating the temperature condition with respect to these two limits, variable capacity compressor that is electrically fed and controlled by means of an actuating electronic circuit capable of measuring a variable associated with the load imposed on the compressor motor, for instance, the electric power and rotation or torque or the force on the piston, this electronic circuit that actuates the compressor being also provided with a microcontroller and a variable-time valve stored inside the microcontroller. The control system for controlling the cooling of an ambient comprises a variable capacity compressor and a controller, the controller measuring the load of the compressor and verifying the temperature condition in the cooled ambient and actuating on the cooling capacity of the compressor. The control system for cooling an ambient to be cooled comprising an electric motor driven compressor, the motor being fed by an electric current, the compressor having a variable-capacity, and the system further comprising a controller measuring a load of the compressor by means of the measurement of the electric current and verifying the temperature condition inside the cooled ambient and actuating on the cooling capacity of the compressor, the controller controlling the compressor to actuate in cycles, the cooling capacity being altered in function of an evolution of the load of the compressor along the cooling cycles in combination with an evolution of the temperature condition in the cooled ambient.

The objectives of the present invention are achieved by means of a control method for an electrically fed compressor that is controlled by an electronic circuit, this control electronic circuit carrying out measurements of the variable associated with the load imposed on the compressor, the microcontroller comparing the variation rate of this variable associated with the load imposed on the compressor with a maximum reference value previously stored in the microcontroller, the microcontroller increasing the cooling capacity of the compressor proportionally to this load variation rate, if this rate of variation of the load imposed on the compressor is higher than the reference value stored in the microcontroller. The microcontroller receives the information about temperature condition of the cooled ambient with respect to the two predefined limits, interrupts the operation or the compressor, if the temperature is lower than the predefined minimum limit for temperature inside the cooled ambient and initiates a new operation cycle of the compressor, if the temperature is higher than the predefined maximum limit for temperature inside the cooled ambient. The microcontroller initiates the operation of the cooling system in its first operation or cooling cycle, or after an interruption of power, at a predetermined and high capacity, providing a high cooling capacity in the first cycle. The microcontroller records the value of the load imposed on the compressor when the minimum limit of temperature inside the cooled ambient is reached, compares this load value with the load value required by the compressor after the beginning of the operation at the subsequent cycle. This cycle begins with a predetermined and low cooling capacity, associated with the situation of best energetic efficiency of the system. The microcontroller increments the capacity of the compressor in a proportion of $K^*L_2/L_1$ between the load $L_2$ right after $t_1 \div t_2$ the beginning of operation of the new cooling cycle and the load $L_1$ required at the end of the previous cycle, if this relation $L_2/L_1$ between the loads is higher than a predetermined limit R. The microcontroller periodically measures the load $L_2$, at periods of time $t_2$, along two cooling cycles following the first cooling cycle. The microcontroller increments the cooling capacity of the compressor in a proportion $K^*L_2/L_1$ between the load $L_2$ right after the periods of time $t_2$ and the load $L_1$ measured at the end of the preceding cooling cycle, or measured right after the last alteration of capacity S of the compressor, if this relation $L_2/L_1$ between the loads is higher than a predefined limit R.

The control method of a cooling system includes steps of measuring the load of the compressor along one cooling cycle, the cycle beginning when the temperature condition in the cooled ambient indicates that the temperature is higher than a maximum value permitted; calculating a relation between the stored value of a second variable and the stored value of a first variable $L_1$, the second variable $L_2$ corresponding to the load of the present cooling cycle, and the first variable corresponding to the load prior to the last alteration of capacity of the compressor, following the steps of altering the value of the cooling capacity if $$\frac{L2}{L1} > R \text{ then } S = \frac{S \cdot L2}{L1} \cdot K$$

and storing the value of the second variable in the first variable, a reference value being pre-established and a constant value being pre-established, or maintaining the present cooling capacity if $$\frac{L2}{L1} \leq R \text{ then } S = S,$$

and maintaining the value of the first variable.

The objectives of the present invention are further achieved by means of a cooler comprising a variable-capacity compressor, a controller controlling the capacity of the compressor, the compressor being driven by an electric motor the motor being fed by an electric current, an evaporator and the evaporator being associated with the compressor and being positioned in at least one cooled ambient, the controller actuates the compressor in cooling cycles to maintain the temperature condition in the cooled ambient within pre-established maximum and minimum limits of temperature conditions, the controller measures the load of the compressor, and actuates on the cooling capacity of the compressor in function of the load on the compressor in combination with the temperature condition in the cooling ambient, the measuring of the load of the compressor being made by of the measurement of the electric current.

BRIEF DESCRIPTION OF THE DRAWINGS

The present invention will now be described in greater detail with reference to an embodiment represented in the drawings. The figures show.

DETAILED DESCRIPTION OF THE FIGURES

Figure 1:
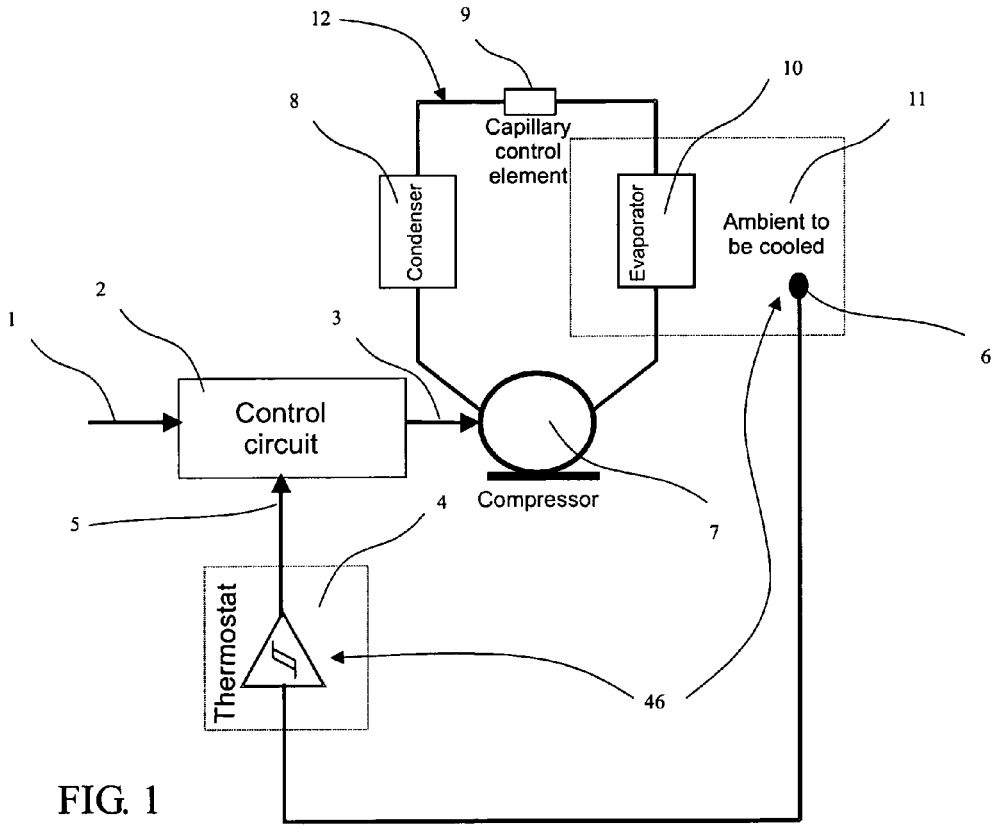
FIG. 1: a schematic diagram of the control system for controlling the cooling of a cooled ambient according to the present invention.

According to FIG. 1, the system basically comprises a condenser 8, an evaporator 10 positioned in an ambient 11 to be cooled, a capillary control element 9, a compressor 7. It may include a thermostat 4 and an electronic controller 2 for controlling the capacity S of the compressor 7, which actuates in cycles. The compressor 7 promotes the flow of the gas inside the cooling circuit 12, which leads to the withdrawal of heat from the ambient to be cooled 11. A temperature sensor 6 integrating the thermostat 4 checks the temperature and compare the result of this checking with predefined limits $T_1$, $T_2$ in order to supply to the control circuit 2 the information 5 about this temperature condition inside the ambient to be cooled 11. The capacity control circuit 2 of the compressor 7 absorbs a power value 1 from the feed network and supplies current 3 to the motor M of the compressor 7.

Figure 2:
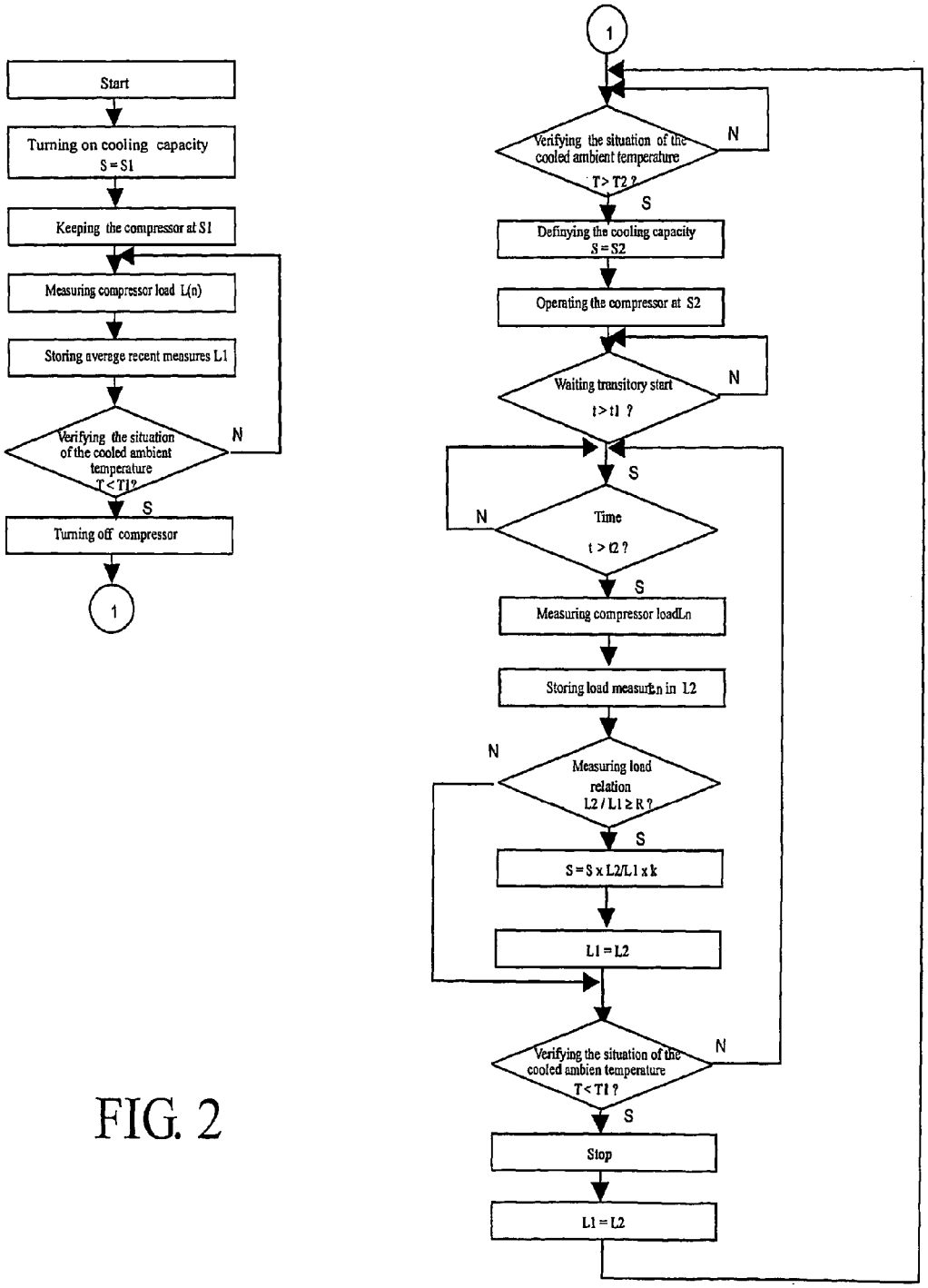
FIG. 2: a flow diagram of the control method for the cooling system according to the present invention.

According to FIG. 2, the control system controlled by means of a control method of the present invention consists in establishing, in a first cooling cycle of the cooling system, a predefined cooling capacity S with a high value S1, causing the compressor 7 to promote a high level of mass and, consequently, a rapid reduction in temperature T of the cooled ambient 11. This high cooling capacity $S_1$ may be achieved by raising the functioning speed of the compressor 7. According to the teachings of the present invention, the load Ln of the compressor 7 is measured along the first cooling cycle, when the compressor is functioning, and the compressor is kept in operation until the cooled ambient 11 reaches the desired minimum temperature value $T_1$. Then the compressor 7 is turned off, and the average load $L_1$ demanded by the compressor 7 at the end of the first cooling cycle immediately before it is turned off is stored.

In this situation, with the compressor 7 turned off, the cooled ambient 11 becomes to get warm due to the heat leakage through the insulation of the cooled ambient 11 and due to thermal loads that may be added to the inside of the latter, causing the temperature T to rise. This rise in temperature T will cause the cooled ambient 11 to reach the maximum permitted temperature $T_2$. Then, thermostat 4 will send a signal 5 to the control 2 informing the detection of this temperature condition, commanding the turning-on of the compressor 7. According to the proposed control method for controlling a cooling system, the compressor 7 will be turned on again at a predefined cooling capacity $S=S_2$, chosen so as to promote the operation of the system consuming the least possible value of energy. This cooling capacity $S_2$, of higher efficiency, generally corresponds to the lowest capacity of the compressor 7, which corresponds to the lowest operation speed in the case of variable-capacity rotary-movement compressors. The measurement of the load Ln imposed on the compressor 7 after it is turned on is made after a predefined transition period $t_1$ has passed, basically depending upon the constructive characteristics of the cooling system to be controlled. In this period the functioning pressures are being established, and the load value Ln imposed on the compressor 7 still does not represent adequately the thermal load condition of the cooling compressor. After the transition period $t_1$ has passed, the average load value $L_2$ imposed to the compressor 7 is periodically measured, at predetermined intervals of time $t_2$. Then, one calculates the relation $L_2/L_1$ between the average load value $L_2$ in the last functioning period and the load value $L_1$ of the compressor 7 in the preceding cooling cycle; this relation is then compared with a predefined constant R. The cooling capacity S of the compressor 7 will be corrected in a proportion K of this relation between the loads $L_2/L_1$, if this relation is higher than the predefined constant R. In this condition, the loan value $L_1$ is updated with the last load value $L_2$ measured in the present cooling cycle. The cooling capacity S of the system will be maintained if the relation $L_2/L_1$ between the loads is lower than the constant R.

If $$\frac{L2}{L1} > R \text{ then } S = \frac{S \cdot L2}{L1} \cdot K,$$

and $L_1=L_2$

If $$\frac{L2}{L1} \leq R \text{ then } S = S$$

The constant R is predefined in function of the sensitivity to variations of thermal load required for the cooling system to be controlled, and the constant K is a pre-established factor, which depends upon the rapidity in the evolution of the temperatures required for the cooling system, in case a thermal load variation takes place. Typically, such values may be of about the following values: R=1,05 and K=1,20.

Then, one checks the temperature T condition inside the cooling ambient 11, maintaining the compressor 7 in operation, if the minimum temperature T1 has not been reached, repeating the measurement of the load Ln of the compressor 7 in predefined periods of time $t_2$, updating the load value of the last functioning period $L_2$, repeating the cycle of comparison of the relation between the preceding functioning cycle $L_1$ and the load value of the last functioning cycle $L_2$, comparing this relation with a constant R and correcting the cooling capacity S, as it was described above.

This cycle will repeat until the temperature T inside the cooled ambient 11 reaches the minimum temperature value $T_1$ and the compressor 7 is commanded to turn off. Then the load value of the compressor 7 in the last operation period $L_2$ is transferred to the variable that keeps the load value of the preceding cycle $L_1$, the compressor being kept turned-off until the temperature inside the cooled ambient 11 rises and reaches the maximum value $T_2$. Then the compressor 7 is commanded to operate again in a new cooling cycle, again in a cooling capacity S equal to a predefined value $S_2$, corresponding to a condition of lower consumption of energy, repeating the whole cycle.

Figure 3:
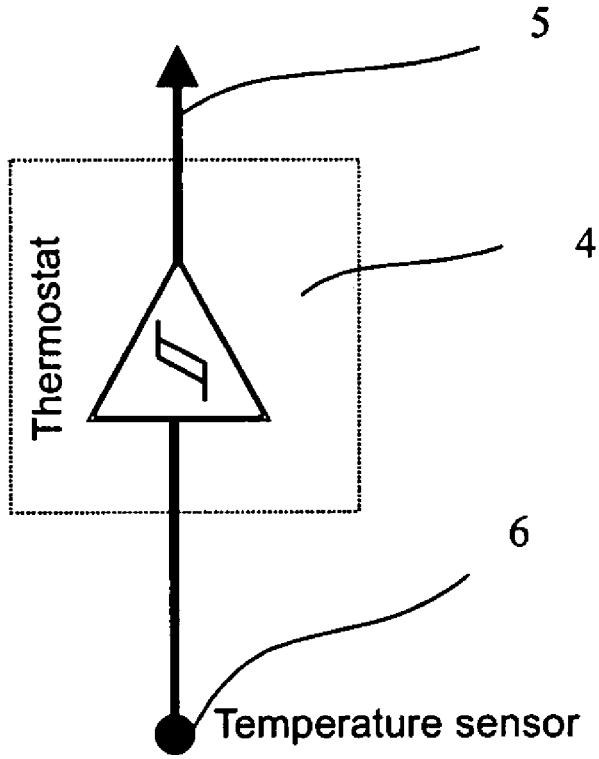
FIG. 3: a detailing of the characteristics of the thermostat used in the system of the present invention.

FIG. 3 illustrates the relation between the temperature condition T in the cooled ambient 11 and the command signal 5 delivered by the thermostat 4, which senses the temperature by the sensor 6 and generates a signal 5, which will indicate whether the temperature T has reached the minimum value $T_1$ or the maximum value $T_2$, provided with a hysteresis, as illustrated in the graph.

Figure 4:
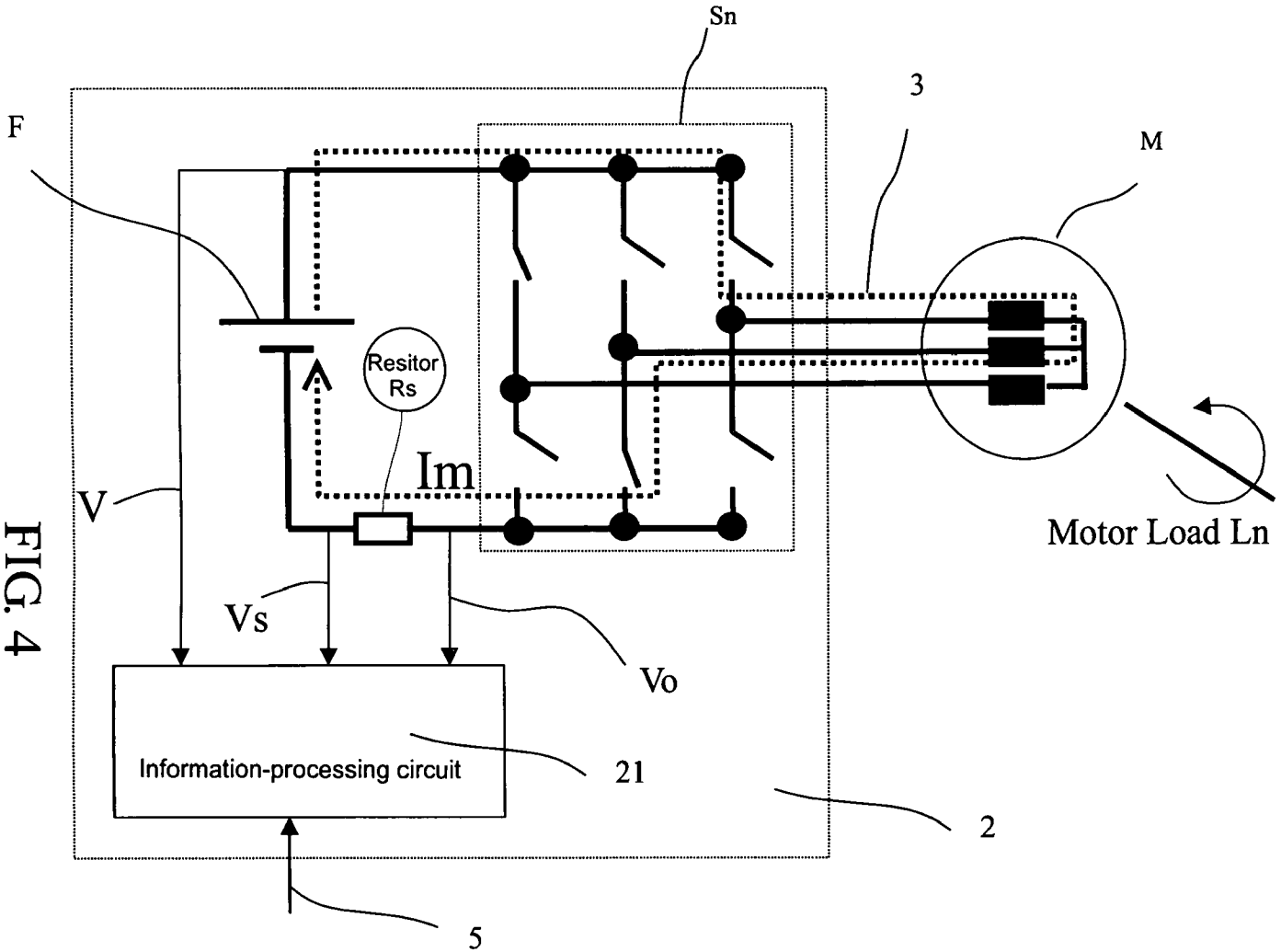
FIG. 4: a schematic diagram of the control circuit of the compressor according to the present invention.

In FIG. 4, which describes in detail the electronic capacity control 2 of the compressor 7, wherein the current Im fed to the motor M circulates through the keys of an inverting bridge Sn and through the resistor $Rs_1$ on which a drop in voltage Vs is generated, which is proportional to the current Im circulating through the motor M applied by the source F. The information of the feed tension V applied to the motor M, the information of voltage Vs on the current-sensing resistor Rs, and the reference voltage VO are supplied to an information-processing circuit 21, which consists of a microcontroller or a digital signal processor. The load or mechanical torque Ln on the motor M of the compressor 7 is directly proportional to the current Im circulating through the windings of this motor M. In the case of motors with brushless permanent magnets, this relation is virtually linear. The quite precise calculation of the load Ln of the compressor 7 may then be made by observing the current value Im circulating through the current-resisting resistor Rs, which is read by means of the voltage Vs on this resistor Rs by the information-processing circuit 21. The load Ln of the compressor 7 approximately obeys a linear relation between the voltage on the current-sensing resistor Rs and a correction constant $K_{torque}$.

$$Ln = Vs.K_{torque}$$

In the case in which there is pulse-width modulation of the voltage on the motor M, the average current value Im in the phase of the motor M corresponds to the average of the current value observed on the current-sensing resistor Rs, calculated during the periods in which the keys of the inverting bridges Sn are closed, since the current Im circulating through the windings of the motor M does not circulate through the sensing resistor Rs during the period in which the keys Sn are open.

An alternative way of calculating the load Ln on the compressor 7 is to divide the value of power P delivered to the motor M by the turning speed of the motor, this power P being calculated by the product of the voltage V and the current Im on the motor M. In this way, the value of the load on the compressor 7 may be calculated by the expression:

$$Ln = \frac{V \cdot \mathrm{Im}}{\text{Turning speed}}$$

Figure 5A:
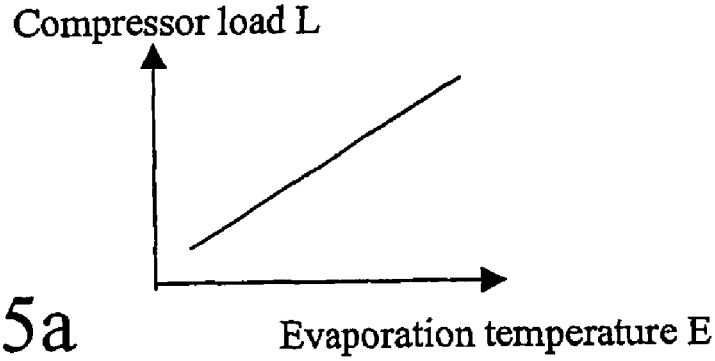
FIG. 5*a*: relation between the evaporation temperature in the compressor and the resulting mechanical load.
Figure 5B:
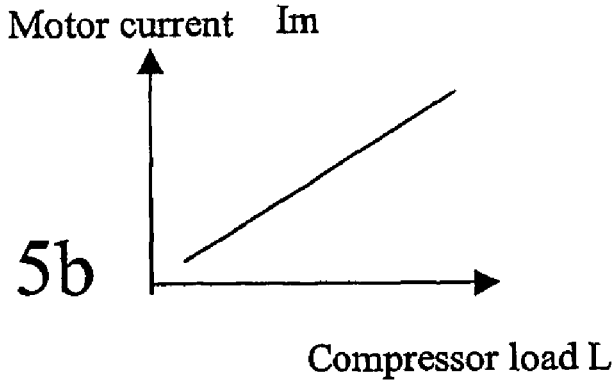
FIG. 5*b*: relation between the mechanical load on the compressor and the current in the motor phases.
Figure 5C:
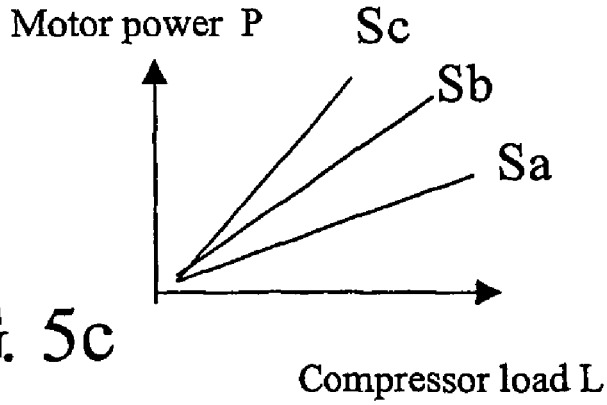
FIG. 5*c*: relation between the mechanical load on the compressor and the power absorbed by the compressor at different rotations.

As shown in FIG. 5*a*, the torque on the motor M or the load Ln on the compressor 7 maintains a proportionality with the evaporation temperature E, which in turn keeps a strong correlation with the thermal load on the cooling system. In this way, when the cooled ambient 11 is higher at a temperature T, for example, during an initial functioning period of the system to be controlled, or when a thermal load is added to the interior of the cooled ambient 11, the evaporation temperature E in the evaporator 10 is higher, requiring more work by the compressor 7, which results in a greater torque or greater load Ln on the compressor 7 and consequently in a more intense current in the phases of the motor M, as indicated in the graph of FIG. 5*b*. The value of power P absorbed by the motor M is directly related to the torque and turning speed, as illustrated in the graph of FIG. 5*c*, where one can see different capacities Sa, Sb and Sc of the compressor 7, Sc being the highest capacity. This highest capacity corresponds to a higher speed in the case of compressor with a turning mechanism.

The value of the load Ln, characterized by the torque on the axis of the gas-pumping mechanism and, consequently, of the axle of the motor, in the case of rotary-movement compressors, or characterized by the force or load Ln on the piston (not shown) in the case of linear-movement compressors, is predominantly dependent upon the gas-evaporation temperature, which is imposed by the cooling system. This evaporation temperature corresponds directly to a gas pressure, which in turn results in a force on the piston of the pumping mechanism and, consequently, in a torque on the axle of the mechanism. There is a close correlation between the temperature in the cooled ambient and the gas-evaporation temperature due to the good thermal coupling between the cooled ambient and the evaporator 10. Supposing that the evaporation temperature is constant, this load Ln, is essentially constant for any functioning rotation of the compressor, or amplitude of piston oscillation, being therefore a variable that represents the situation and the behavior of the cooled ambient 11 very well. When the compressor is commanded to operate at different cooling capacities S, which is characterized by different rotation speeds or different piston course, the cooling system reacts, leading to changes in the gas pressures, altering the temperatures of condensation and evaporation, which in turn will cause alterations on the load Ln of the compressor.

In the case of application on a linear-type compressor 7, the power P is supplied to the motor M will be proportional to the product of the load Ln on the respective piston by the speed of displacement of this piston of the compressor 7, the controller 2 will be responsible for controlling the speed of piston displacement.

In other words, the load Ln is virtually independent of the rotation/oscillation, depending only on the gas-evaporation temperature that circulates through the cooling circuit 12. Secondary factors influence the value load Ln when the rotation/oscillation are alternate, but a small magnitude, being negligible in the face of the effect of gas-evaporation temperature. Some of the most important secondary effect are the friction of the materials and the losses due to viscous friction of the gas.

When the compressor is commanded to operate at different cooling speeds S, which is characterized by different rotation speeds or different piston course, the cooling system reacts, leading to changes in the gas pressures, altering the temperatures of condensation and evaporation, which in turn will cause alterations on the load Ln of the compressor.

Figure 6:
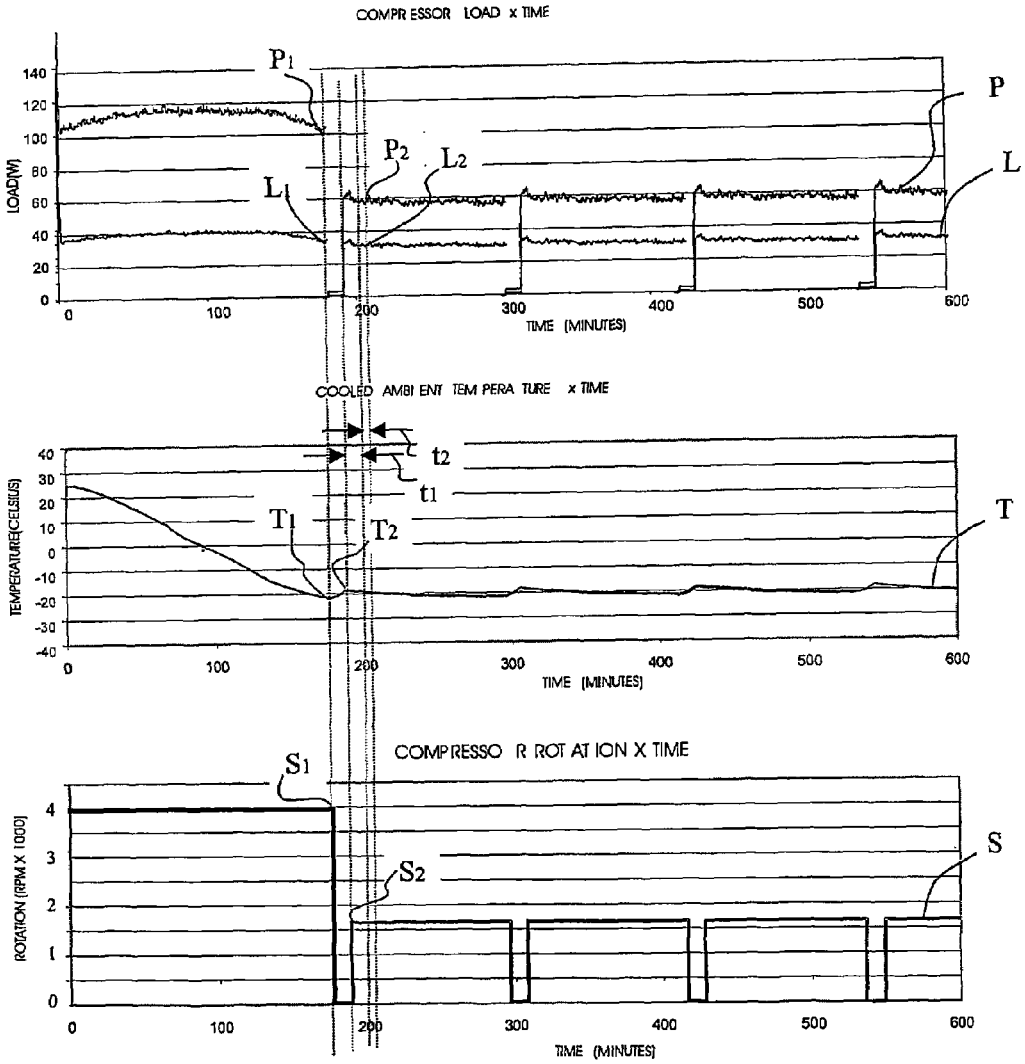
FIG. 6: curves of power and mechanical load of the compressor, related with the internal temperature of the cooled ambient and related to the cooling capacity adjusted for the compressor, in an initial period of functioning of the system.

In FIG. 6, one illustrates the evolution of the variables of power P absorbed by the compressor 7, which actuates in cycles, torque of the motor or load Ln of the compressor 7, temperature T inside the cooled ambient 11 and cooling capacity S of the compressor 7.

During the initial period of functioning, when the temperature T is high, much higher than the minimum desired value $T_1$, the proposed method establishes a high cooling capacity $S=S_i$, which consists of a high functioning rotation in the case of rotary-movement compressor. This condition of high cooling capacity S guarantees that the temperature T in the cooled system 11 will be reduced in a minimum time, imparting high performance to this cooling system in this regard. Throughout the functioning period, the thermostat 4 observes the temperature T inside the cooled ambient 11, and the control circuit 2 effects the measurement of the load Ln of the compressor 7, and the average of this value of load is calculated for the more recent period of time, this period being on the order of a few seconds or minutes, storing the result in a variable $L_1$. When the temperature T inside the cooled ambient 11 reaches the minimum desired value $T_1$, the thermostat will send a command 5 to the electronic controller 2, which will command the stop of the compressor.

The value of power $P_1$ absorbed by the compressor 7 in this final operation period prior to the turning-off, or directly the load value $L_1$ on the compressor 7 in this final operation period is stored.

As soon as the temperature T or the temperature situation T inside the cooled ambient 11 rises and reaches the maximum permitted value $T_2$, the thermostat 4 generates the command 5, informing the control 2 of this situation, causing the compressor 7 to restart its functioning. The compressor 7 will restart its functioning adjusted for a cooling capacity S, predefined $S_2$, which promotes the minimum consumption of energy. This value of cooling capacity $S_2$ is determined while designing the system and usually corresponds to the minimum cooling capacity of the compressor 7, that is to say, the minimum functioning rotation in the case of rotary-movement compressors.

Right after the restart of functioning of the compressor 7, one observes that the value or power P absorbed presents a peak, which is due to the transition of pressures in the cooling system, which, after a period of time $t_1$, reach a more stable condition and begin to correspond to the thermal condition of the system to be controlled. This transitory period may last up to 5 minutes. For the adequate functioning of the proposed method, the measurements of load Ln of the compressor 7 are started after this period of time $t_1$ has passed. After this period of wait $t_1$ for accommodation of the start transition, one begins the measurement of the load Ln of the compressor 7 during a determined interval of time $t_2$, this interval being determined by the desired speed for the reactions of the system to be controlled with addition of thermal loads and being limited to the constant itself of the cooling system, which presents a certain delay for appearance of variations in the evaporation pressure when some thermal disturbance is imposed on the system, as for example addition of hot food, prolonged opening of the door (if the system and method are applied to a cooler), etc. This interval of time $t_2$ typically may be on the order of from a few seconds up to a few minutes. The value of the load $L_2$ of the compressor 7 is calculated in the final period of this interval of time $t_2$, and one makes the average of the last readouts of the instantaneous values Ln form the purpose of eliminating the normal oscillations due to the disturbances present in the feed network and noises inherent in the measuring process.

In this moment, when the value of the average load of the period $L_2$ has been calculated, the process follows, as illustrated in FIG. 2.

Figure 7:
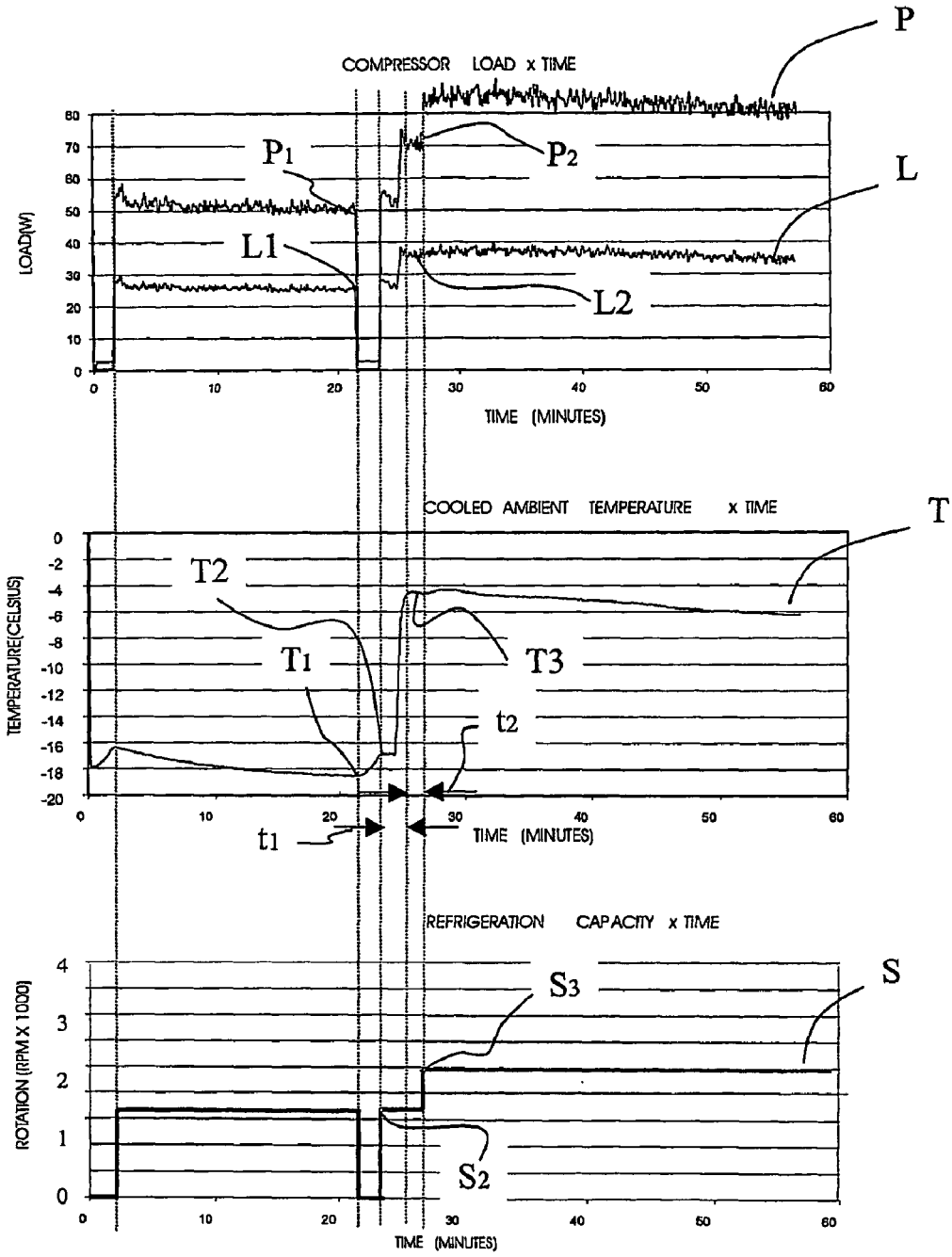
FIG. 7: curves of power and mechanical load of the compressor, related to the internal temperature of the cooled ambient and relates to the cooling capacity adjusted for the compressor, in a regime period, when the thermal load is added to the cooling system.

FIG. 7 illustrates a situation in which, right after the start of functioning of the compressor 7, at a cooling capacity S equal to the capacity of best energetic performance of the system $S=S_2$, there is a thermal disturbance in the cooled ambient 11, raising the temperature from a value $T_2$ to a higher value $T_3$, which in turn causes a disturbance on the load L of the compressor 7. The load value $L_2$ measured at this last period, after this interval of measurement $t_2$, results in a value quite higher than that load value $L_1$ measured in the preceding period, right after the compressor 7 is turned off. In this way, the relation $L_2/L_1$ between the load values of the least period of measurement and the preceding period will result, according to the example, in a value higher than the predefined constant $R_1$ thus meeting the condition in which the capacity of the compressor 7 will be corrected. The capacity S of the compressor 7 will then be corrected in accordance with the relation:

If $$\frac{L2}{L1} > R, \text{ then } S = \frac{S \cdot L2}{L1} \cdot K$$

Thus, the compressor 7 will begin to operate at a higher cooling speed $S_3$, and will cause the temperature T in the cooled ambient 11 to return rapidly to the desired interval, between the pre-established maximum $T_2$ and the minimum $T_1$. One observes that the capacity S of the compressor 7 is made at each interval of measurement $t_2$ and will be in the proportion of the thermal load added to the system to be controlled, thus guaranteeing a rapid and adequate reaction of the system.

The correction of cooling capacity S of the compressor 7 may occur more times along the period in which the compressor 7 is functioning.

In a particular case, in which the cooling capacity S of the compressor 7 is approximately in balance with the demand required by the system to be controlled, the temperature T could undergo rises as time passes at a too small rate to be detected between the intervals of measurement $t_2$. In theses cases the method proposed in FIG. 3 guarantees that the load value $L_1$ representing the final load of the preceding period will be used as a reference throughout the period of operation of the compressor 7, enabling one to correct the capacity S of the compressor 7 in these cases in which the increase in load occurs very slowly.

A preferred embodiment having been described, it should be understood that the scope of the present invention embraces other possible variations, being limited only by the contents of the accompanying claims, which include the possible equivalents.

The invention claimed is:

1. A cooling control system for cooling an ambient to be cooled (11), the system comprising an electric motor (M) driven compressor (7), the motor (M) being fed by an electric current (Im), the compressor (7) having a variable-capacity (5), the system comprising:

a controller (2) measuring a load (Ln) of the compressor (7) by means of the measurement of the electric current (Im) and verifying the temperature condition inside the cooled ambient (11) and actuating on the cooling capacity (S) of the compressor (7), the controller (2) controlling the compressor (7) to actuate in cycles, the cooling capacity (S) being altered as a function of an average of the load (Ln) of the compressor (7) over a selected time along the cooling cycles in combination with an average of the temperature condition in the cooled ambient (11) over a selected time.

2. A cooling control system according to claim 1, wherein the controller (2) comprises an information-processing circuit (21), the information-processing circuit (21) measuring the current (Im).

3. A cooling control system according to claim 2, wherein a resistor (Rs) is associated with the information-processing circuit (21), and in that the current (Im) circulates through the resistor (Rs).

4. A cooling control system according to claim 3, wherein a power (P) proportional to the product of the load (Ln) by a rotation of the compressor (7) is fed to the motor (M), the controller (2) controlling the rotation of the compressor (7).

5. A cooling control system according to claim 4, wherein a power (P) proportional to a product of the load (Ln) on a piston by a displacement speed of the compressor (7) piston is fed to the motor (M), the controller (2) controlling the displacement speed of the compressor (7) piston.

6. A cooling control system according to claim 4, wherein the controller (2) comprises an information-processing circuit (21), the information-processing circuit (21) measuring the power (P).

7. A cooling control system according to claim 1, wherein the cooling system (12) comprises an evaporator (10), the evaporator (10) being associated with the compressor (7) and being positioned in the cooled ambient (11).

8. A cooling control system according to claim 7, wherein it comprises a temperature-sensing assembly (46) associated with the information-processing circuit (21), the temperature-sensing assembly (46) verifying the temperature condition of the cooled ambient (11).

9. A cooling control system according to claim 8, wherein the information-processing circuit (21) comprises pre-established values of maximum (T2) and minimum (T1) temperature condition, the values of maximum (T2) and minimum (T1) temperature corresponding to the maximum and minimum temperatures in the cooled ambient (11).

10. A cooling control system according to claim 9, wherein it the controller (2) starts the compressor (7) at a cooling capacity (S1) that is substantially close to the maximum capacity of the compressor (7) and reduces the temperature of the cooling ambient (11) to a minimum temperature (T1), and maintains the compressor (7) off for a pre-established period of time (t1) when the minimum temperature (T1) is reached, the value of the time (t1) being stored in the controller (2), the controller (2) storing a first variable (L1) of the load (Ln) when the minimum temperature (T1) is reached, the controller (2) restarts the compressor (7) at a substantially lower cooling capacity (S2) than the maximum cooling capacity (S1) and stores a second variable (L2) of the load (Ln) during application of the substantially lower cooling capacity (S2) until the minimum temperature (T1) has been reached, the controller (2) substitutes the value of the first variable (L1) by the value of the second variable (L2).

11. A method of controlling a cooling system that comprises a compressor (7) having a load (Ln) and cyclically applying a cooling capacity (S) to cooled ambient (11), the cooling capacity (S) being variable, the method comprising the following steps:

measuring the load (Ln) of the compressor (7) along a cooling cycle, the cycle being initiated when the temperature condition in the cooled ambient indicates that the temperature (T) is higher than a maximum permitted value (T1), calculating a relation (L2/L1) between the stored value of a second variable (L2) and the stored value of a first variable (L1), the second variable (L2) corresponding to the load (Ln) of the present cooling cycle, and the first variable corresponding to the load (Ln) prior to the last alteration of capacity (S) of the compressor (7)

following the steps of:

a) altering the value of the cooling capacity (S) if $$\frac{L2}{L1} > R \text{ then } S = \frac{S \cdot L2}{L1} \cdot K$$

and storing the value of the second variable (L2) in the first variable (L1), (R) being a pre-established reference value and (K) being a pre-established constant value, or b) maintaining the present cooling capacity (S) if $$\frac{L2}{L1} \leq R \text{ then } S = S$$

and maintaining the value of the first variable (L1).

12. A method according to claim 11, wherein the step of measuring the load (Ln) of the compressor (7) is initiated after a first pre-established period of time (t1) has passed from the beginning of the cooling cycle.

13. A method according to claim 11, wherein, after measuring the load (Ln) of the compressor (7), it comprises a step of storing, in the second variable (L2), the value of the load (Ln) measured.

14. A method according to claim 11, wherein, after the step of altering the value of the cooling capacity (S), and the step of maintaining the cooling capacity (S), it comprises a step of checking the temperature condition (T) in the cooled ambient (11).

15. A method according to claim 14, wherein one returns to the measurement of the load (Ln) of the compressor (7) after a second waiting time (t2) has passed.

16. A method according to claim 11, wherein, after the step of checking the temperature condition (T) in the cooled ambient (T), one returns to the step of measuring the load (Ln) of the compressor if the temperature condition (T) in the cooled ambient indicates that a minimum value (T2) has not been reached.

17. A method according to claim 11, wherein the one finishes the present cooling cycle if the temperature condition (T) in the cooled ambient (11) indicates that a minimum value (T2) has been reached.

18. A method according to claim 11, wherein the beginning of the cooling cycle comprises the steps of operating the compressor (7) at a cooling speed (S2) substantially lower than a capacity (S1), the capacity (S1) being substantially close to the maximum capacity of the compressor (7).

19. A method according to claim 11, wherein the step of initiating the first cooling cycle is characterized by:

operating the compressor (7) at the cooling capacity (S1) corresponding to a capacity substantially close to the maximum capacity of the compressor (7) in a first cooling cycle;

measuring the load (Ln) of the compressor (7);

storing a more recent value of the average of the loads (Ln) of the compressor (7) along the cooling cycle in a first variable (L1), when the compressor (7) is operating in a first cooling cycle or after an interruption of operation thereof;

checking the temperature condition (T), finishing the operation of the compressor (7) if the situation is lesser than (T1).

20. Method according to claim 11, wherein the compressor (7) is driven by an electric motor (M), the motor (M) being fed by an electric current (Im), and that in the step of measuring the load (Ln) of the compressor (7) along a cooling cycle, the measurement is made by the means of the measurement of the electric current (Im).

21. A cooler comprising:

a variable-capacity (S) compressor (7), a controller (2) controlling the capacity (S) of the compressor (7), the compressor (7) being driven by an electric motor (M) the motor (M) being fed by an electric current (Im), an evaporator (10); and the evaporator (10) being associated with the compressor (7) and being positioned in at least one cooled ambient (11);

wherein the controller (2) actuates the compressor (7) in cooling cycles to maintain the temperature condition (T) in the cooled ambient (11) within pre-established maximum and minimum limits (T1, T2) of temperature conditions, the controller (2) measures the load (Ln) of the compressor (7), and actuates on the cooling capacity (S) of the compressor (7) as a function of an average of the load (Ln) on the compressor over a selected time in combination with an average of the temperature condition in the cooling ambient (11) over a selected time, the measuring of the load (Ln) of the compressor (7) being made by of the measurement of the electric current (Im).

22. A cooler according to claim 21, wherein a cooling cycle of the compressor (7) is turned on when the temperature condition (T) in the cooled ambient (11) indicates that the maximum limit (T2) has been reached.

23. A cooler according to claim 21, wherein the cycle of cooling the compressor (7) is interrupted when the temperature condition (T) in the cooled ambient (11) indicates that the minimum limit (T1) has been reached.

24. A cooler according to claim 21, wherein it comprises:

a cooling circuit (12) comprising a cooling fluid having an evaporation temperature (E) and the controller (2) receiving the information about the temperature in the cooled ambient (11).

25. A cooler according to claim 24, wherein the electric current (Im) fed to the motor (M) associated with the compressor (7) is proportional to the load (Ln).

26. A cooler according to claim 25, wherein a resistor (Rs) is associated with the information-processing circuit (21), and in that the current (Im) circulates through the resistor (Rs).

27. A cooler according to claim 24, wherein a power (P) proportional to a product of the load (Ln) by a rotation of a compressor (7) axle is fed to the motor (M), the controller (2) controlling the rotation of the compressor (7) axle.

28. A cooler according to claim 27, wherein the controller (2) comprises an information-processing circuit (21), the information-processing circuit (21) measuring the power (P).

29. A cooler according to claim 24, wherein a power (P) proportional to a product of the load (Ln) on a piston by the displacement speed of the compressor (7) piston is fed to the motor (M), the controller (2) controlling the displacement speed of the compressor (7) piston.

30. A cooler according to claim 21, wherein the cooling circuit (12) comprises an evaporator (10), the evaporator (10) being associated with the compressor (7) and being positioned in the cooled ambient (11).

31. A cooler according to claim 30, wherein it comprises a temperature-sensing assembly (46) associated with the information-processing circuit (21), the temperature-sensing assembly (46) measuring the temperature in the cooled ambient (11).

* * * * *